US012599204B2

(12) United States Patent
Szöke et al.

(10) Patent No.: US 12,599,204 B2
(45) Date of Patent: Apr. 14, 2026

(54) SETTING AND METHOD FOR SETTING A DECORATIVE ASSEMBLY

(71) Applicant: Dress Your Body AG, Cormondrèche (CH)

(72) Inventors: Tamás Szöke, Neuchâtel (CH); Stéphane Lauper, Cortaillod (CH); Lionel Blaser, Corcelles (CH); Alexandre Netuschill, Le Cerneux-Péquignot (CH)

(73) Assignee: Dress Your Body AG, Cormondrèche (CH)

( * ) Notice: Subject to any disclaimer, the term of this patent is extended or adjusted under 35 U.S.C. 154(b) by 160 days.

(21) Appl. No.: 17/974,001

(22) Filed: Oct. 26, 2022

(65) Prior Publication Data

US 2023/0165343 A1 Jun. 1, 2023

(30) Foreign Application Priority Data

Dec. 1, 2021 (EP) ..... 21211740

(51) Int. Cl.
*A44C 17/02* (2006.01)

(52) U.S. Cl.
CPC ..... *A44C 17/0208* (2013.01)

(58) Field of Classification Search
CPC ..... A44C 17/0208; A44C 17/02; A44C 17/04; B23P 5/00
See application file for complete search history.

(56) References Cited

U.S. PATENT DOCUMENTS 664,725 A * 12/1900 Costigan ..... A44C 17/02 63/15
2,117,736 A * 5/1938 Link ..... A44C 17/04 63/27
4,750,245 A * 6/1988 Moussouris ..... A44C 17/043 269/157
6,491,424 B1 * 12/2002 Tardy ..... G04B 39/00 368/283
D754,023 S * 4/2016 Dholakiya ..... D11/92
(Continued)

FOREIGN PATENT DOCUMENTS

JP 2004337354 A * 12/2004
JP 2005288071 A * 10/2005

OTHER PUBLICATIONS

European Search Report of EP 21 21 1740 dated May 10, 2022.

*Primary Examiner* — Jason W San
*Assistant Examiner* — Anna S Rashid
(74) *Attorney, Agent, or Firm* — Sughrue Mion, PLLC

(57) ABSTRACT

A setting (1), including, aligned along an axis for driving into a bed (8) of a piece of jewellery or timepiece (9), an upper body (15) including a first surface (2) to receive a component to be set (10), a setting element (4) to hold the component (10), and a lower body (16) including a second front surface (6), between which bodies (15; 16) a deformable area (7) is plastically deformable under the action of an axial driving force greater than a predetermined driving force, to bring the setting (1) into a stressed state wherein the deformable area (7) is irreversibly deformed and/or fractured, in the form of a clot radially pushing back a peripheral surface (3) of the setting (1) towards a lateral wall of the bed (8), or/and in the form of a fault radially pushing back the upper body (15) towards this lateral wall.

18 Claims, 5 Drawing Sheets

(56) References Cited

U.S. PATENT DOCUMENTS

| | | | | |
|---|---|---|---|---|
| 9,402,450 | B2 * | 8/2016 | Huynh | B23P 5/00 |
| 10,238,190 | B2 * | 3/2019 | Huynh | A44C 17/02 |
| 11,064,777 | B2 * | 7/2021 | Uldry | A44C 17/02 |
| 11,147,348 | B2 * | 10/2021 | Lauper | A44C 17/02 |
| 2015/0121959 | A1 * | 5/2015 | Huynh | A44C 17/04 63/26 |
| 2019/0191832 | A1 * | 6/2019 | Uldry | A44C 17/02 |

* cited by examiner

SETTING AND METHOD FOR SETTING A DECORATIVE ASSEMBLY

CROSS REFERENCE TO RELATED APPLICATIONS

This application claims priority to European Patent Application No. 21211740.2, filed on Dec. 1, 2021, the entire contents of which are incorporated herein by reference.

TECHNICAL FIELD OF THE INVENTION

The invention relates to a setting, including an upper body, extending around an axis defining a direction for driving said setting into a bed of a piece of jewellery or timepiece, and including a first surface arranged to receive a component to be set, at least one setting element arranged to ensure the holding of said component to be set, and, aligned with said upper body, a lower body including a second front surface.

The invention also relates to a setting assembly including a piece of jewellery or timepiece, which includes at least one bed arranged to receive such a setting.

The invention also relates to a method for producing a decorative assembly with setting of a component to be set arranged to cooperate with a setting in a bed of a piece of jewellery or timepiece.

The invention relates to the field of setting attached elements, particularly components to be set such as stones, pearls, cameos or similar, on pieces of jewellery or timepieces.

TECHNOLOGICAL BACKGROUND

The setting of attached elements on a piece of jewellery or timepiece is a delicate operation, because the security of holding such an attached element must be ensured in any circumstance, in particular during contact with the clothes of the user, or with other objects or people. The trade value of these attached elements may indeed be very high, if it concerns precious stones or similar.

Modern pieces of jewellery or timepiece often include structural elements such as cases, crystals, bracelet links, or others, which are produced in materials that have no plastic deformation, often hard and/or fragile, such as for example ceramic, silicon, sapphire, intermetallic alloys or also metal, natural or polymer matrix composites.

Therefore, the use of an intermediate setting between the structure and decorative element is essential for making it possible to set such decorative elements. Indeed, their soldering on the structure is generally impossible, and their possible gluing directly on the structure does not have sufficient resistance guarantees over time and in any circumstances of use.

The use of settings made of plastic or shape-memory material is a solution making it possible to hold the setting well in its bed, but which is not very suitable for fastening decorative elements of very small size, and the installation is delicate, requiring better qualified staff; the cost of such a setting is, furthermore, fairly high, and the choice of an elastic material is difficult to reconcile with the deformation of setting elements such as claws or grains, generally used for holding the decorative element on the setting. In addition, such elastic settings are not aesthetically pleasing.

It is therefore delicate to combine the imperatives of holding, cost, easy installation, in particular when the piece of jewellery or timepiece is produced in a hard substrate, that is difficult to or cannot be machined, and when the decorative element is of small dimensions.

SUMMARY OF THE INVENTION

The invention proposes to provide a simple and economical solution to the problem of setting decorative elements on structural elements made of hard material.

To this end, the invention relates to a setting according to claim 1.

The invention also relates to a setting assembly including a piece of jewellery or timepiece, which includes at least one bed arranged to receive such a setting.

The invention also relates to a method for producing a decorative assembly with setting of a component to be set arranged to cooperate with a setting in a bed of a piece of jewellery or timepiece.

BRIEF DESCRIPTION OF THE FIGURES

The aims, advantages and features of the invention will be presented in the following description, with reference to the appended drawings wherein:

FIG. 7 is a section passing through the axis of the setting, of a setting according to the invention, also including a foot such as the setting of FIGS. 1 to 6, inserted in a revolution bed and that includes a slight undercut; at this stage the setting has been driven up to a bearing position between the front surface of the foot, and a flat face of the bed; the setting is then ready to undergo a supplementary axial force, illustrated by a downward axial double arrow, to deform the lower portion of the setting and push it towards the lower wall of the bed, according to radial double arrows;

FIG. 8 illustrates the continuation of the axial thrust force, beyond a force predetermined by the experiment, and shows the fracture of the setting between the foot and the upper body, the foot is already broken and separated from the upper body, and the foot (which here is shown for visibility with hatchings different from those of the upper body) plays the role of a spacer, which imparts to the lower portion of the upper body a radial force tending to push it back towards the outside, that is to say towards the inner wall of the bed;

FIG. 9 illustrates the axial end of travel, when the lower portion of the upper body can only form a clot pressed against the inner wall of the bed, and ensuring the axial holding of the setting;

Figure 11:
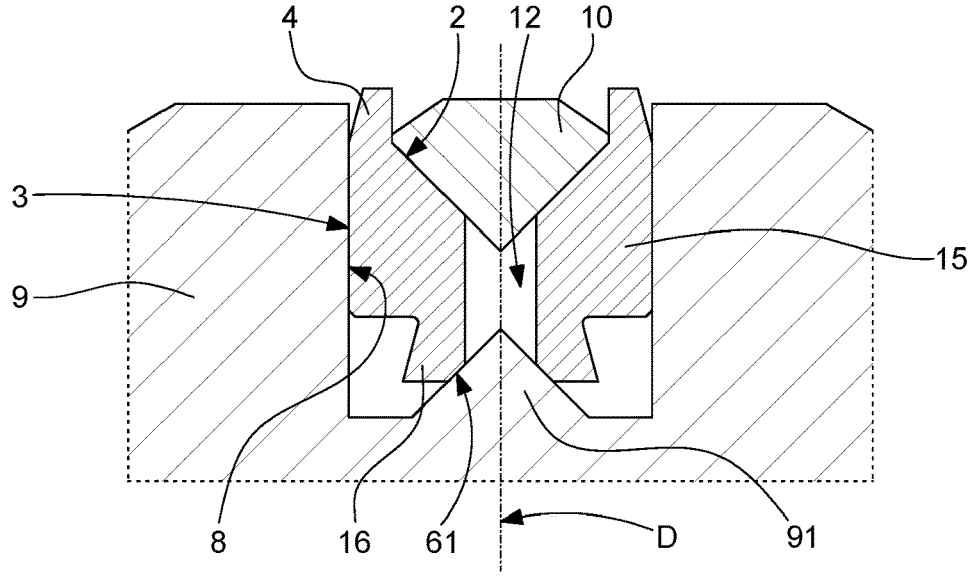
Figure 12:
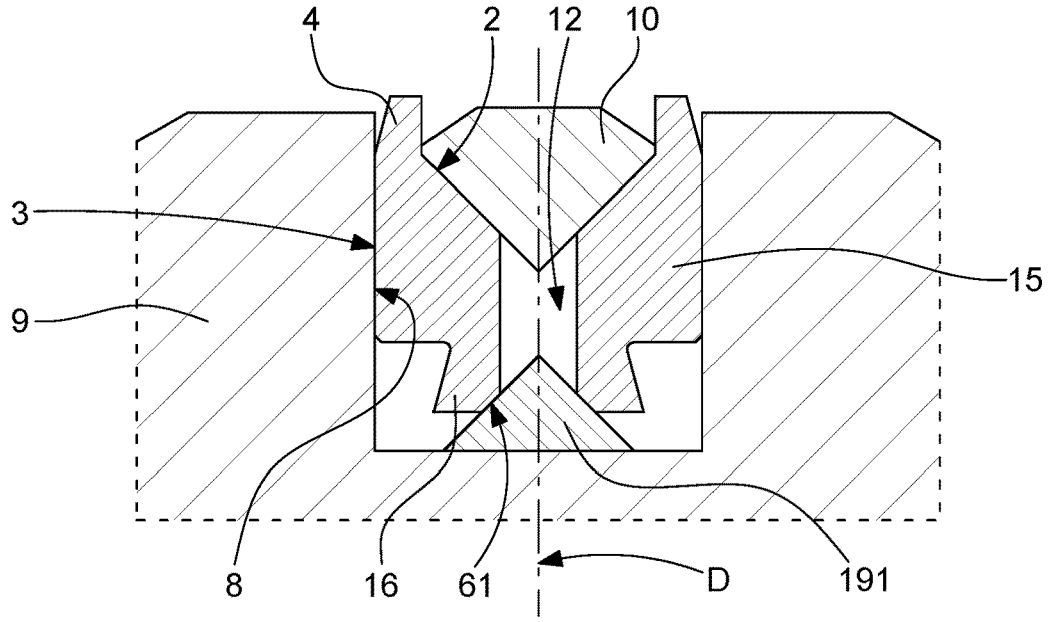
Figure 13:
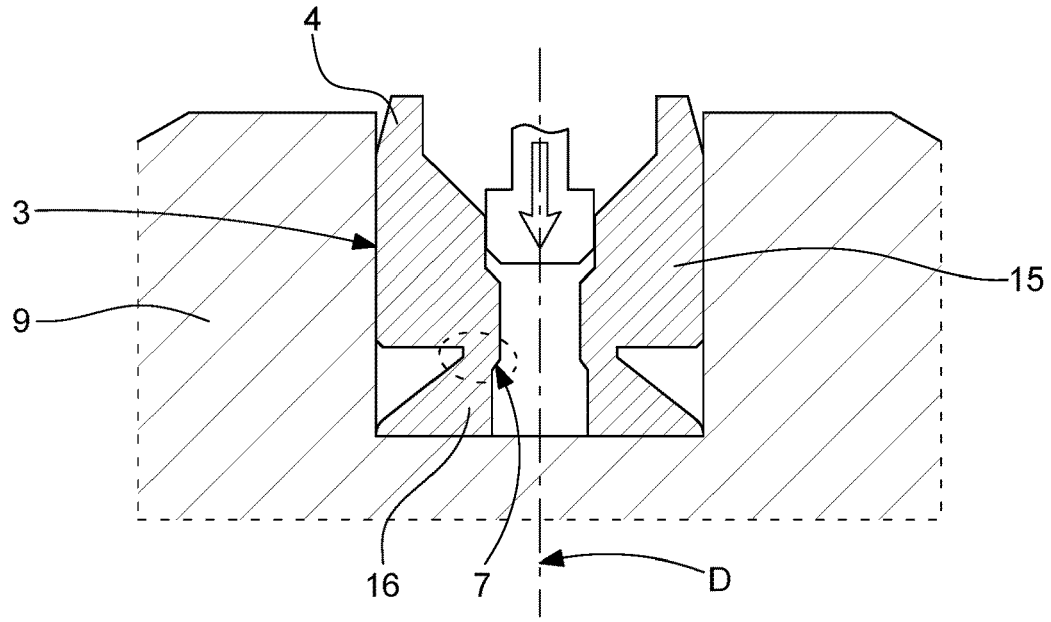
Figure 14:
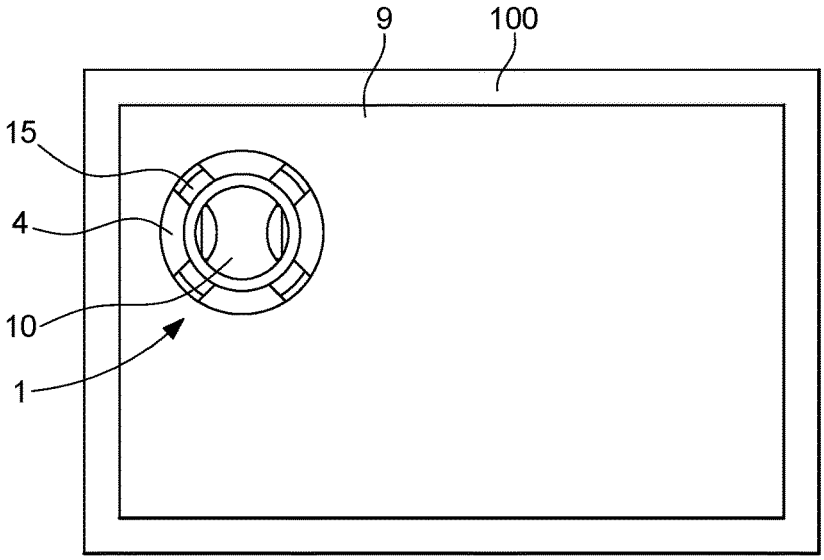
Figure 15:
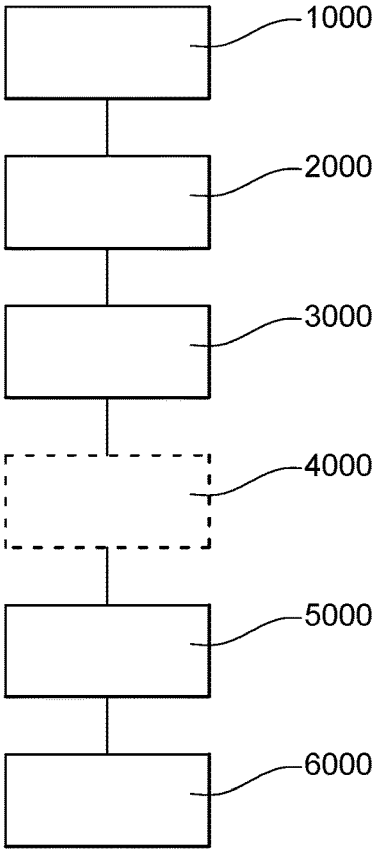

in the right-hand portion a variant with an inner tapping in an axial orifice of the setting makes it possible to insert a threaded tool, not shown, with a threading of diameter larger than that of this tapping to deform the deformable area, such a tapping may also make it possible to insert a threaded bushing here shown in the lower portion to ensure the radial holding after deformation of the deformable area; this same right-hand portion shows the square edge join between a truncated foot and the upper body;

in the left-hand portion it can be seen successively, by moving away from the axis: a variant with a blind axial orifice in the setting, another variant with an opening axial orifice, a variant with a recess in the lower body to attach the front support towards the peripheral area, a variant with a lower body in the shape of a skirt with a hollow truncated inner surface, a variant with the outer profile of such a skirt set back from the upper body, and a variant with the most outer profile of this skirt substantially at the radial of the upper body;

FIG. 11 is a section passing through the axis of the setting, of another variant of setting according to the invention, the lower portion of which forms a skirt including a female evolutive surface widening towards its lower portion, and which is arranged to cooperate with a male evolutive surface that includes the bed, here in one-piece form;

FIG. 12 is a variant of FIG. 11, with a male intermediate component deposited beforehand in the bottom of the bed, to cooperate with the same female evolutive surface of the setting;

FIG. 13 is a section passing through the axis of the setting, of another variant of setting according to the invention, wherein a deformation tool comes to deform the deformable area, shown in dashed line between the foot and the upper body, and which is affected by the travel of this deformation tool;

FIG. 14 is a block diagram showing a setting assembly including a piece of jewellery or timepiece, which includes at least one bed arranged to receive such a setting, and a decorative element;

FIG. 15 is a block diagram with the steps of a method for setting such an assembly.

DETAILED DESCRIPTION OF THE INVENTION

The invention relates to the setting of decorative elements, particularly but not limited to stones, on a piece of jewellery or timepiece. The invention more particularly relates to the case of such pieces of jewellery or timepieces, which include structural elements made of hard material, on which a setting must be performed. The manufacture of beds for receiving decorative elements is sometimes very difficult to achieve, according to the nature of the material concerned, and the method for manufacturing this structural element itself. For example, in a material such as a ceramic, or a sapphire, or similar, it is possible to produce beds including an undercut, and a cylindrical bed is already considered as a good result. The problem is amplified when both the decorative element to be set and the bed are of very small size. It should be noted that the use of a setting is unavoidable in such cases.

The aim of the invention is to reconcile the secured holding of the decorative element to be set in its setting, and of the setting in its bed, the correct geometrical positioning of the decorative element to be set and of its setting in relation to the bed, the control of the cost of the components, the aesthetic appearance of the assembly, and the implementation of the operation for installing the setting and for setting the decorative element by staff with average qualification.

The invention proposes to produce a setting of a particular shape, easy to machine, of very moderate cost, and of aesthetic similar to that of a standard setting.

To this end, the invention relates to a setting 1, including an upper body 15, extending around an axis A defining a direction for driving said setting 1 into a bed 8 of a piece of jewellery or timepiece 9. This upper body 15 includes at least one first surface 2, which is arranged to receive at least one component to be set 10, and at least one setting element 4 that is arranged to ensure the holding of this component to be set 10. This setting element 4 may be a setting claw, or similar. The setting 1 also includes, axially aligned with this upper body 15, a lower body 16 that includes a second front surface 6.

According to the invention, the setting 1 includes, at least between the upper body 15 and the lower body 16, at least one deformable area 7, which is plastically deformable under the action of a force at least axial imparted to the setting 1 in the driving direction, greater than a predetermined driving force, to bring the setting 1 into a stressed state.

In this stressed state, this at least one deformable area 7 is irreversibly deformed and/or fractured, or even in the form of a clot radially pushing back a peripheral surface 3 of the setting 1 towards a lateral wall of the bed 8 during the application of this force, or/and in the form of a fault radially pushing back the upper body 15 towards such a lateral wall during the application of this force.

More particularly, the upper body 15 includes such a peripheral surface 3, which is arranged to guide and hold the setting 1 in complementary cooperation with a bed 8 of a piece of jewellery or timepiece 9. The figures illustrate the most common case where the bed 8 is a female element, for example a bore or a pocket, and where the setting 1 is inserted into the bed 8; however the invention applies in the opposite case, not illustrated by the figures, where the bed 8 is a male element, and where the setting 1 covers this male element.

Thus the setting 1 includes this upper body 15, located on a first axial side (which is that which will be visible by the user of the piece of jewellery or timepiece 9), and extends around an axis A, which defines a direction for inserting and driving the setting 1 into a bed 8. Its first surface 2 is arranged for the substantially front reception of at least one component to be set 10, and at least one setting element 4 is located in the vicinity of the first surface 2, and is arranged to ensure the holding, particularly by setting, of a component to be set 10. This setting element 4 may be a setting claw, or similar.

At least one lower body 16 is located on a second axial side opposite the first axial side. The embodiments illustrated, not limiting, include a single lower body 16, which is enough to ensure a good holding of the setting 1 and of the decorative elements 10 that it carries.

More particularly, the second substantially front surface 6 constitutes an abutment surface that is arranged to, at the end of travel of inserting the setting 1 into or on a bed 8, cooperate in abutment bearing with an additional abutment surface 96 that includes this bed 8, or also with an intermediate component 191 inserted into this bed, as can be seen on the variant of FIG. 12.

More particularly, the deformation of this at least one deformable area 7 is carried out under the action of a force at least axial imparted to the setting 1 in the driving direction after the start of abutment cooperation between the second substantially front surface 6 and a complementary abutment surface 96. "Force at least axial" means either a purely axial force such as traditional driving, or a force combining an axial movement and a rotational movement such as screwing.

More particularly, the at least one deformable area 7 has a breaking strength, in said driving direction, which is lower than that of said setting 1 in the vicinity of each at least one first surface 2, and in that at least one deformable area 7 includes, in the vicinity of the second surface 6, at least one neck of section smaller than the smallest section of the setting 1 in the vicinity of each first receiving surface 2.

Figure 1:
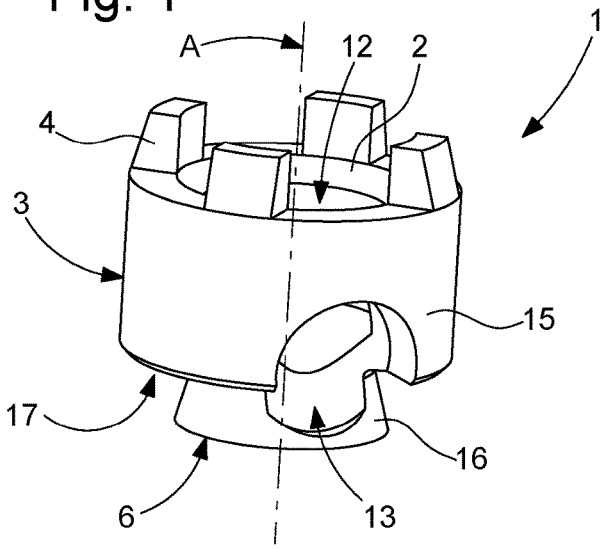
FIG. 1 shows, schematically and in perspective, a setting according to the invention, adapted to cooperate with a substantially cylindrical bed, in a particularly advantageous embodiment wherein this setting includes, in the upper portion a substantially tubular upper body and including a shoulder, here conical, to receive a decorative element such as a stone, surrounded by setting elements here in the form of slots constituting claws capable of being folded down on this decorative element, and in the lower portion a lower body consisting of a foot in truncated cone, with two substantially radial blind holes passing through both the upper body and the foot.
Figure 4:
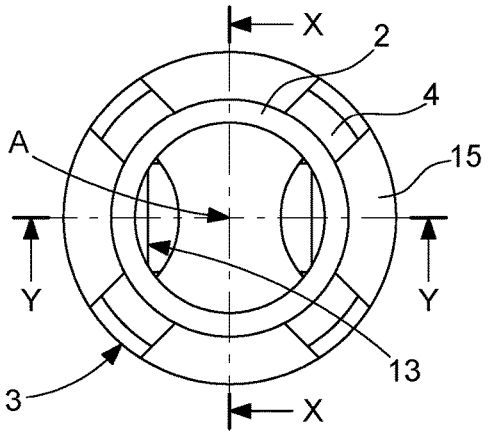
FIG. 4 is a top view of the setting of FIG. 1.
Figure 2:
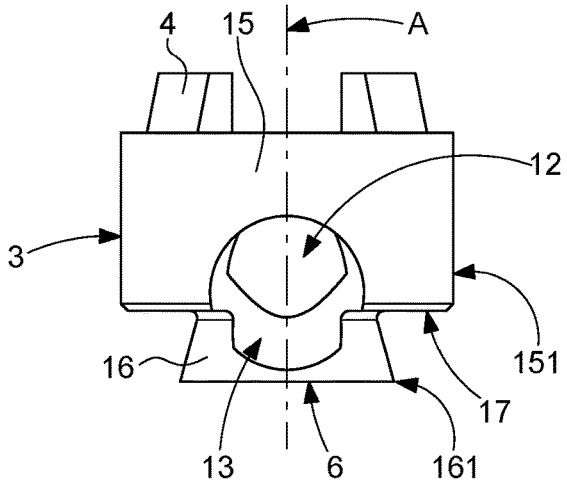
FIG. 2 is a side view, in the axis of one of the radial holes, of the setting of FIG. 1.
Figure 5:
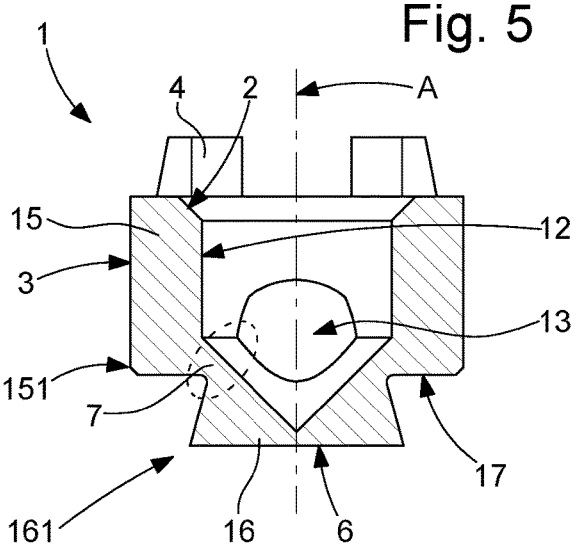
FIG. 5 is a section passing through the axis of the setting, in the position of FIG. 2.
Figure 3:
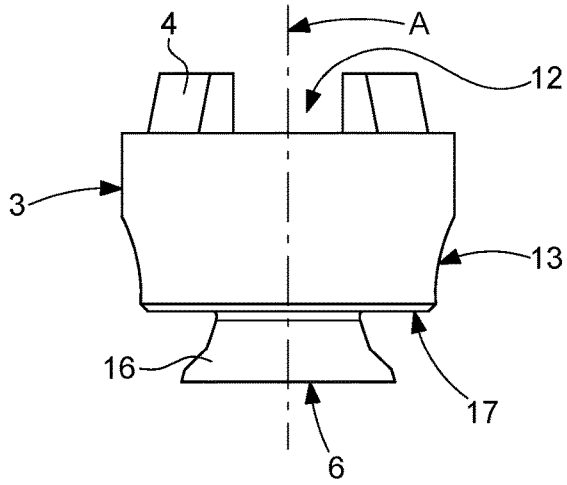
FIG. 3 is a side view, set square of the radial holes, of the setting of FIG. 1.
Figure 6:
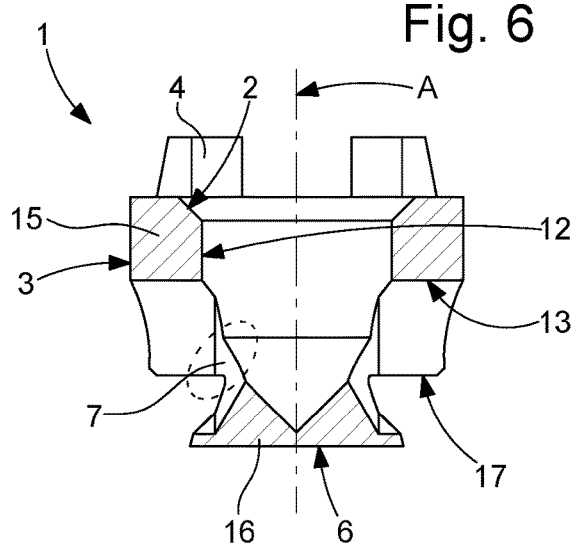
FIG. 6 is a section passing through the axis of the setting, in the position of FIG. 3; a deformable area is identified by a dashed line at the intersection of the axial orifice and of one of the radial holes.
Figure 7:
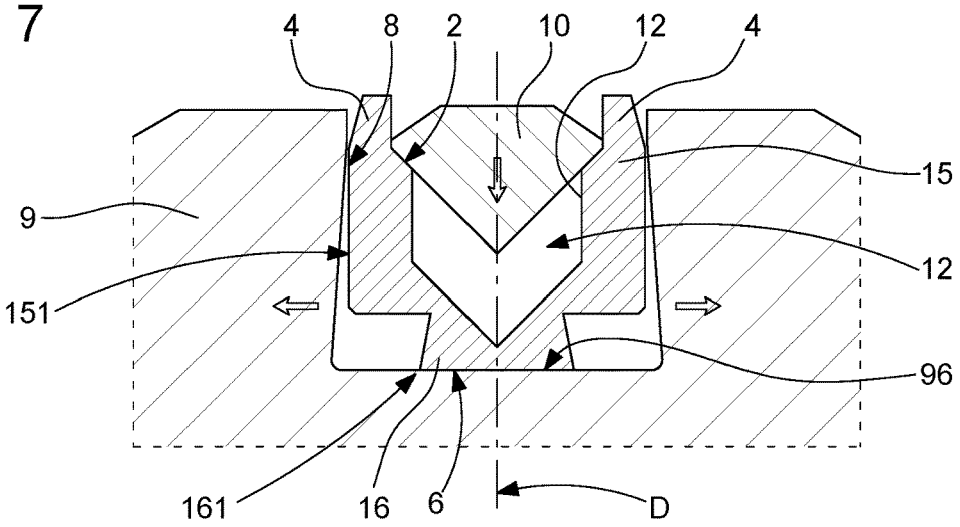
FIGS. 7 to 9 are simple diagrams showing the kinematics of the progressive holding of the setting in its bed.
Figure 8:
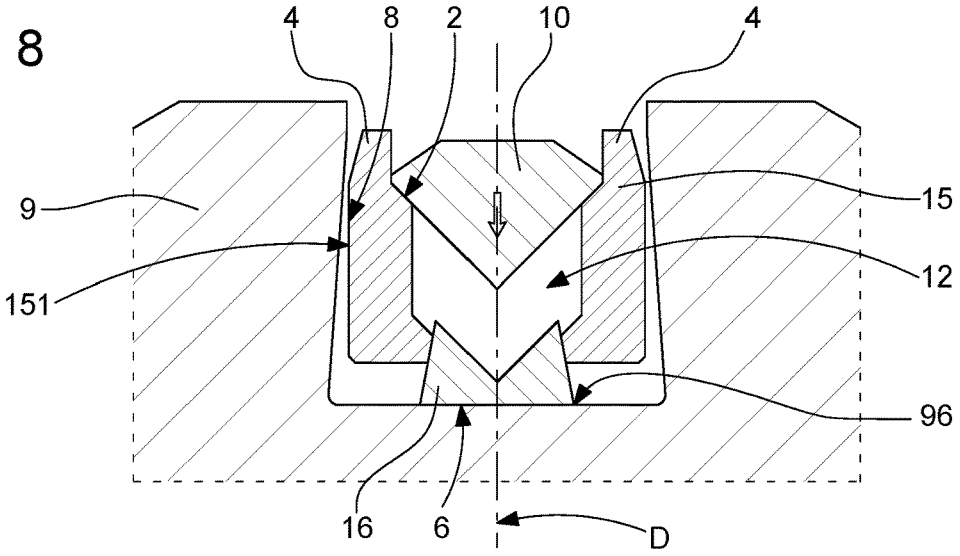
Figure 9:
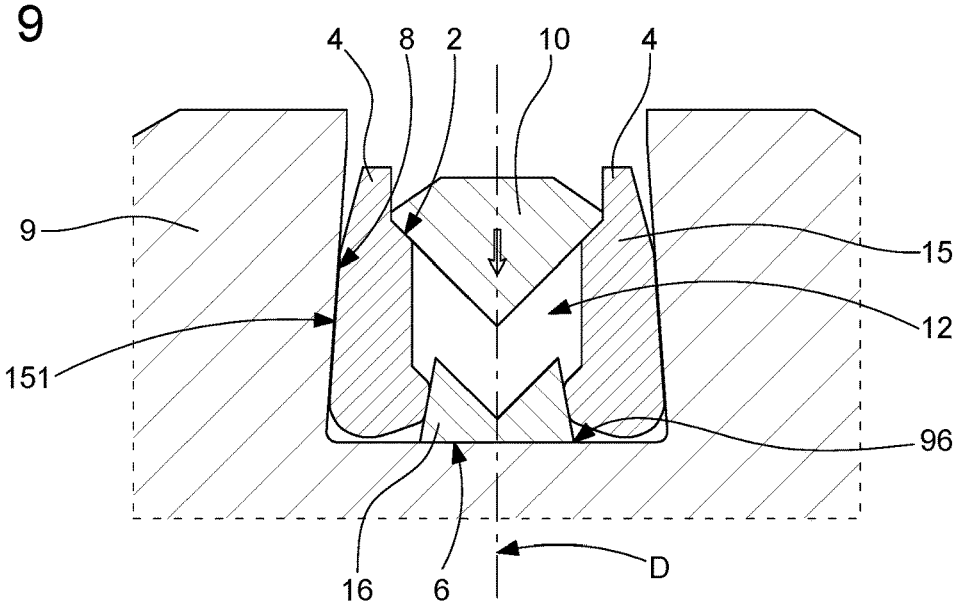

More particularly, and as can be seen in certain figures, the setting 1 includes an axial orifice 12 along the axis A. In addition, as can be seen particularly in FIGS. 1 and 6, at least one deformable area 7 extends between this axial orifice 12 on the one hand, and a substantially radial orifice 13 or/and a hollow on the other hand.

More particularly, the setting 1 includes at least one such substantially radial orifice 13, which is perpendicular or oblique in relation to the axis A, and at least one neck extends between the axial orifice 12 on the one hand, and the substantially radial orifice 13 on the other hand.

More particularly, the axial orifice 12 and at least one radial orifice 13 are intersecting.

More particularly, and as can be seen particularly in FIGS. 1 to 9, the setting 1 includes at least one lower body 16 that consists of a foot. This foot is connected to the upper body 15 by at least one deformable area 7 which is more ductile and/or more fragile than the upper body 15, and which is arranged to bend or break during the application of a force at least axial greater than the predetermined driving force imparted to the setting 1, and the deformation or the breakage of which modifies the radial position of the upper body 15 or/and of the at least one foot, to hold the setting 1 frictionally bearing with a bed 8.

Such a foot can be produced easily by profile-turning or similar, the cost of the setting is thus controlled. A simple groove or a chamfer may be sufficient to define a weak or deformable area. Such a foot makes it possible to impose the location of friction surfaces between the setting 1 and the bed 8.

More particularly, the peripheral surface 3 is located between the first axial side and the second axial side, and at least one such foot 16 is arranged in the vicinity of the second surface 6.

More particularly, the axial orifice 12 passes through the upper body 15, and at least partially the foot 16.

More particularly, at least one radial orifice 13 passes through at least partially the upper body 15, and at least partially the foot 16.

More particularly, the foot 16 joins the upper body 15 at a secondary surface 17 where the section of the foot 16 is smaller than the section of the foot 16 at the second surface 6 that delimits it from the side opposite the secondary surface 17.

The holding is particularly good for a setting 1 thus drilled along its axis, and that includes a foot that fractures when it is bearingly driven on an opposing surface. This foot then rises in the hole 12 of the setting 1, and compresses the setting 1 in its bed 8. The decorative element 10 may then be set at any moment.

More particularly, the foot 16 includes a hollow 160 in its axial portion around the axis A.

More particularly, as can be seen in FIGS. 1 to 9, the foot 16 is of substantially truncated shape with its geometrical tip directed towards the first axial side.

In a first variant, the foot 16 and the upper body 15 form a one-piece assembly.

In a second variant, the foot 16 is distinct from the upper body 15 to which it is fastened.

Figure 10:
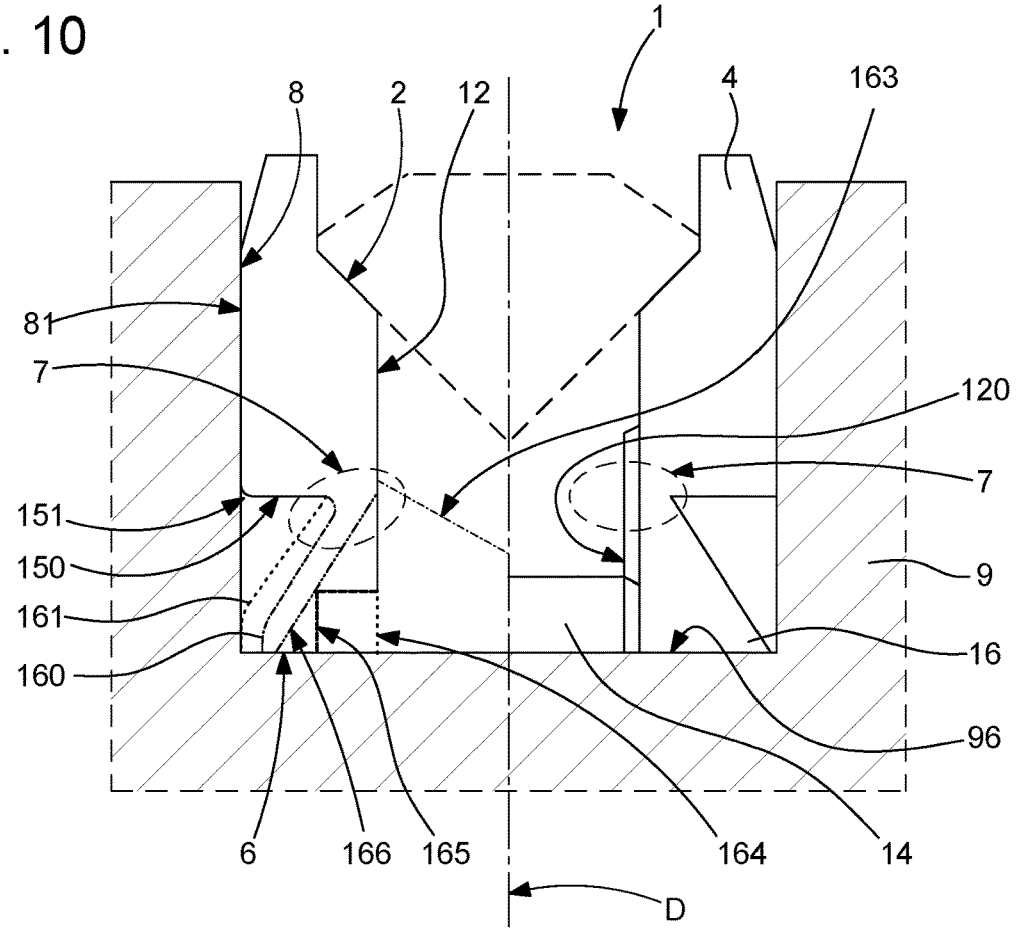
FIG. 10 is a section passing through the axis of the setting, showing, in superposition, a non-limiting sample of various variants of setting according to the invention, with various shapes given to the upper body and to the lower body.

More particularly, as can be seen in the right-hand portion of FIG. 10, the setting 1 includes a tapping 120 along the axis A, which is arranged to cooperate with a tool equipped with a threading of diameter larger than that of the tapping 120 to deform the deformable area 7 and deform the foot 16 and bring at least one surface of the setting 1 frictionally bearing in cooperation with a bed 8.

More particularly, the setting 1 includes a removable bushing 14, which is arranged to be driven or screwed along the axis A to prevent the radial removal of the foot 16 after the deformation of the deformable area 7 and the cooperation of the setting 1 frictionally bearing with the bed 8.

More particularly, the upper body 15 includes, on the side opposite the first axial side, a first lip 150 deformable during a deformation of a deformable area 7 with a first radial portion 151 arranged to exert on the bed 8, in the stressed state of the setting 1, a friction force greater than that exerted by the rest of the upper body 15 or by the foot 16. This first lip 150 may particularly be produced, in a variant not illustrated, in the form of a simple skirt.

More particularly, the foot 16 includes, on the second axial side, a second lip 160 deformable during a deformation of a deformable area 7 with a second radial portion 161, that can be seen in a dotted line on the left-hand portion of FIG. 10, arranged to exert on the bed 8, in the stressed state of the setting 1, a friction force greater than that exerted by the upper body 15 or by the rest of the foot 16. This second lip 160 may particularly be produced, in a variant not illustrated, in the form of a simple skirt with an inner surface 166, shown in a particular variant in a doubly dashed line in the left-hand portion of FIG. 10 in the form of a female truncated cone. In a variant in a single dashed line of this same figure, the outer rim 160 of this skirt is, in the non-stressed state, set back from the bed 8.

More particularly, as can be seen in FIG. 11, the setting 1 includes, in the vicinity of the second surface 6, a female evolutive surface 61 widening towards the second axial side, and which is arranged to cooperate with a male evolutive surface 91 that includes a bed 8 for the application of a radial force on the female evolutive surface during the application of a force at least axial greater than the predetermined driving force imparted to the setting 1. More particularly, the female evolutive surface 61 and the male evolutive surface 91 are cones or spherical or ellipsoidal or paraboloidal domes. FIG. 12 illustrates a variant with an intermediate component 191 deposited beforehand in the bottom of the bed 8, to cooperate with the same female evolutive surface 61 of the setting 1.

More particularly, the setting 1 includes an axial orifice 12 along the axis A, and at least one first surface 2 includes elementary receiving surfaces, for the substantially front reception of at least one component to be set 10, which are all distributed around the axial orifice 12, and the peripheral surface 3 includes elementary bearing surfaces that are all distributed around the axial orifice 12.

In one variant, at least one surface of the setting 1, which is not in contact with the bed 8 during the first installation driving, but which is pushed towards the wall of this bed 8 during the application of a force greater than a predetermined force, has a roughness greater than the rest of the setting, or/and is covered with a friction coating arranged to improve the hooking of the setting 1 in the bed from its expansion.

It is understood that the setting 1 according to the invention is designed for the most delicate use case, wherein the generatrices of the walls of the bed 8 are parallel to the insertion direction. The holding of such a setting is thereby only better if the bed 8 includes a slight undercut, such as on the particular examples of FIGS. 7 to 9.

The figures illustrate common cases of beds that have a symmetry of revolution, the invention can be absolutely applied to the production of shaped settings, to cooperate with shaped beds, for example of elliptical section or with polygonal contours, to receive stones according to the most diverse sizes: baguette, heart, cushion, emerald, lozenge, marquise, oval, pear, princess, or others.

The cooperation between the deformable areas and the bed may, either be exerted over the entire section of this bed, or be restricted to certain angular positions, as is the setting.

The invention also has the particular advantage of making it possible to install, on the same piece of jewellery or timepiece, decorative elements neither perfectly sized nor mutually identical, which is very often the case during the use of precious stones, or of pearls, for example.

This installation does not require temperature rise or contact phases with chemicals such as glues, likely to damage the decorative elements. The structure of the piece of jewellery or timepiece is thus perfectly preserved.

The setting according to the invention presents to the view of the user a closed contour, which contributes to the overall pleasing aesthetics of this piece.

The setting 1 may particularly be made of precious metal, particularly a gold, and/or silver, and/or platinum alloy, titanium alloy, stainless steel, copper alloy, or also aluminium alloy.

The invention makes it possible to adapt well to a piece of jewellery or timepiece that is produced in a hard substrate, such as a ceramic, like a zircon, sapphire, glass, or a cermet, metallic glass, amorphous material, or other.

The invention also relates to a setting assembly 100 including a piece of jewellery or timepiece 9, which includes at least one bed 8 arranged to receive such a setting 1. More particularly, this setting assembly 100 includes at least one component to be set 10 arranged to cooperate with such a setting 1.

More particularly, at least one bed 8 includes, substantially of revolution around a bed axis parallel to a direction for driving a setting 1 into a bed 8, an additional abutment surface 96, which is arranged to, during the application of a force at least axial imparted to a setting 1 in the driving direction, greater than a predetermined driving force, exert on a lower body 16 of this setting a radial component force to deform at least one deformable area 7.

This setting assembly 100 advantageously includes a table of correspondence, which defines the value of the predetermined driving force for each pair formed by on the one hand a bed 8 of a particular geometry in a piece of jewellery or timepiece 9 produced in a particular material, and on the other hand a setting 1 of a particular geometry and produced in a particular material. Each bed and setting pair advantageously defines a tightening, or even clearance, value, a force value for the first portion of the driving travel during which the setting does not undergo plastic deformation, and inevitably defines the value of the predetermined driving force beyond which the setting 1 is plastically deformed during its front contact with the bottom of the bed 8, or with an intermediate element 191 inserted between the bottom of the bed 8 and the second substantially front surface 6 of the setting 1. In one variant, this table of correspondence also lists, for each bed and setting pair, the nature and the limit dimensions of the decorative elements 10 that the setting 1 may carry, and, if necessary, the maximum limit value of the thrust force applicable on such a decorative element 10 during its installation and its setting, or even during the driving of the setting 1 into the bed 8 if the setter performs this operation with the decorative element 10 interposed between the first surface 2 for receiving the setting 1 and the driving tool, such as a setting bracket, an electric cylinder, or other. The use of an electric cylinder is advantageous due to the perfect control of low intensity forces such as applied in such settings, and to differentiate the first driving with a force lower than the threshold of the predetermined force, of the continuation of the driving with a force greater than the threshold of the predetermined force, while respecting a maximum force value guaranteeing the integrity of the decorative element 10.

The invention also relates to a method for producing a decorative assembly 100 with setting of a component 10 to be set arranged to cooperate with a setting 1 in a bed 8 of a piece of jewellery or timepiece 9.

According to this method, in a first preparation step 1000, a piece of jewellery or timepiece 9 is provided including at least one bed 8, a setting 1 corresponding to this bed 8, a table of correspondence defining the value of the predetermined driving force for the pair formed by this particular bed 8 and this particular setting 1. In a variant of this first step 1000 an intermediate component 191 of particular shape is inserted into the bottom of the bed 8, before making the setting 1 penetrate therein.

In a second step 2000 of driving and positioning the setting 1, the setting 1 and the bed 8 are aligned in the driving direction, and an axial force lower than the predetermined driving force is exerted on the setting 1, up to an axial abutment position in the bed or up to a predetermined axial position.

In a third step 3000, an axial force is exerted on the setting 1, or on a component to be set 10 that is positioned on a first surface 2 of the setting 1, which is greater than this predetermined driving force, to deform or break at least one deformable area 7, in a stressed state of the setting 1 where its peripheral surface 3 exerts on the bed 8 a friction force greater than that which it exerts thereon in the second step 2000 of driving and positioning the setting 1. It is understood that the application of such an axial force greater than this predetermined driving force may be carried out during the setting operation strictly speaking, after positioning a component to be set 10 on a first surface 2 of the setting 1, and during the application of a force on at least one setting element 4, for example the folding down of a claw, to enclose a decorative element 10 such as a stone.

In a fourth step 4000, the holding of the setting 1 in its bed 8 is checked.

In a fifth step 5000, at least one component to be set 10 is positioned on a first surface 2 of the setting 1, if it has not already been positioned during the third step 3000 above.

In addition, in a sixth step 6000, the setting of this at least one component to be set 10 with at least one setting element 4 is carried out or is completed.

More particularly, during the fourth step 4000 and after checking the holding of the setting 1 in its bed 8, a removable element 14 is inserted into the setting 1 to hold the deformable area in its deformed position.

Naturally, the first preparation step 1000 may include the production of at least one bed 8, in the case where such a bed was not able to be produced during the creation of the piece of jewellery or timepiece 9, or a reworking of this bed 8, particularly to produce a complementary abutment surface 96 according to a particular profile, for example a flat bottom, or also a male evolutive surface 91, or other. This preparation of a bed 8 of the piece of jewellery or timepiece 9 may also consist of introducing a shaped component including such a particular profile, for example, a simple ball, or other. For example, when the structure of the piece of jewellery or timepiece 9 is made of ceramic, this profile may be a form produced directly in ceramic.

In short, the invention makes it possible to produce a simple setting, easy to machine, easy to drive, and therefore economical to manufacture as well as install.

The invention claimed is:

1. A setting (1), comprising:

an upper body (15), extending around an axis (A) defining driving direction for inserting said setting (1) into a bed (8) of a piece of jewellery or timepiece (9), and including a first surface (2) arranged to receive a component to be set (10), at least one setting element (4) extending above the first surface and arranged to ensure the holding of said component to be set (10), and, aligned with said upper body (15);

a lower body (16) including a second front surface (6) arranged to abut said bed, wherein said setting (1) includes, connecting said upper body (15) and said lower body (16), at least one deformable area (7) that is plastically deformable under an axial force imparted to said setting (1) in said driving direction from the upper body towards the lower body, wherein initially said setting (1) and said bed (8) are aligned in said driving direction, and said axial force is exerted on said setting (1) lower than a predetermined driving force that is based on a type of said bed and a type of said setting in association with the type of said bed, to move said setting up to an axial position of abutment between said second front surface in said bed, wherein, thereafter, a further axial force is exerted on said setting (1) or on the component to be set (10) that is positioned on the first surface (2) of said setting (1), greater than said predetermined driving force wherein said at least one deformable area (7) is irreversibly deformed and/or fractured, due to abutment of said second front surface in said bed, in the form of a clot radially pushing back a peripheral surface (3) of said setting (1) towards a lateral wall of said bed (8) during the application of said further axial force, or/and in the form of a fault radially pushing back said upper body (15) towards one said lateral wall during the application of said force.

2. The setting (1) according to claim 1, wherein said second front surface (6) constitutes an abutment surface arranged to, at an end of travel of inserting said setting (1) into said bed (8), cooperate in abutment with an additional abutment surface (96) in said bed (8).

3. The setting (1) according to claim 2, wherein the at least one deformable area (7) is irreversibly deformed after said second front surface (6) abuts one said additional abutment surface (96).

4. The setting (1) according to claim 1, wherein said at least one deformable area (7) has a breaking strength lower than a breaking strength of the upper body of the setting in said driving direction wherein the deformable area comprises a neck.

5. The setting (1) according to claim 1, wherein said setting (1) includes an axial orifice (12) along said axis (A), and wherein at least one said deformable area (7) extends between said axial orifice (12), and a substantially radial orifice (13).

6. The setting (1) according to claim 4, wherein said setting (1) includes an axial orifice (12) along said axis and at least one substantially radial orifice (13) perpendicular or oblique in relation to said axis (A), defining the at least one deformable area creating a neck extending between said axial orifice and said at least one substantially radial orifice.

7. The setting (1) according to claim 5, wherein said axial orifice (12) and at least one said substantially radial orifice (13) are intersecting.

8. The setting (1) according to claim 1, wherein said setting (1) includes said lower body (16) consisting of a foot connected to said upper body (15) by at least one said deformable area (7) that is more ductile or more fragile than said upper body (15) and that is arranged to irreversibly deform and/or fracture during the application of the further axial force which modifies a radial position of said upper body (15) or/and of said foot, to hold said setting (1) frictionally bearing with said bed (8).

9. The setting (1) according to claim 5, wherein said axial orifice (12) passes through said upper body (15), and at least partially said lower body.

10. The setting (1) according to claim 6, wherein said at least one substantially radial orifice (13) passes through at least partially said upper body (15), and at least partially said foot (16) lower body.

11. The setting (1) according to claim 8, wherein said foot (16) joins said upper body (15) at a secondary surface (17) where a section of said foot (16) is smaller than a section of said foot (16) at said second front surface (6) opposite said secondary surface (17).

12. The setting (1) according to claim 8, wherein said foot (16) is of substantially truncated cone shape with its geometrical tip directed towards said upper body.

13. The setting (1) according to claim 8, wherein said foot (16) and said upper body (15) form a one-piece assembly.

14. The piece of jewelry or timepiece (9) including a setting assembly (100) which includes said bed (8) arranged to receive said setting (1) according to claim 1.

15. The setting assembly (100) according to claim 14, including said component to be set (10) arranged to cooperate with said setting (1).

16. The setting assembly (100) according to claim 14, wherein said bed (8) includes a bed axis aligned with said driving direction when said setting is inserted into said bed.

17. A method for producing a decorative assembly (100) with setting of a component to be set (10) arranged to cooperate with a setting (1) in a bed (8) of a piece of jewellery or timepiece (9), wherein, in a first step (1000) a piece of jewellery or timepiece (9) is provided with a setting (1), having a setting element, corresponding to said bed (8), a table of correspondence defining the value of a predetermined driving force for said bed (8) and said setting (1), in a second step (2000) said setting (1) and said bed (8) are aligned in a driving direction, and an axial force is exerted on said setting (1) lower than said predetermined driving force, up to an axial position of abutment in said bed or even up to a predetermined axial position, in a third step (3000) an axial force is further exerted on said setting (1) or on the component to be set (10) that is positioned on one a first surface (2) of said setting (1), greater than said predetermined driving force, to deform or break a deformable area (7), in a stressed state of said setting (1) where a peripheral surface (3) of said setting exerts on said bed (8) a friction force greater than that which is exerted thereon in said second step (2000) of driving and positioning said setting (1), in a fourth step (4000) the holding of said setting (1) in said bed (8) is checked, in a fifth step (5000) the component to be set (10) is positioned on said first surface (2) of said setting (1) if it has not already been positioned during said third step (3000), and in a sixth step (6000) the setting of said component to be set (10) is carried out or is completed with said setting element (4).

18. The method according to claim 17, wherein, during said fourth step (4000) and after checking the holding of said setting (1) in its bed (8), a removable element (14) is inserted into said setting (1) to hold said deformable area in its deformed position.

* * * * *